US007910182B2

(12) United States Patent
Baker

(10) Patent No.: US 7,910,182 B2
(45) Date of Patent: Mar. 22, 2011

(54) INK-JET RECEIVER HAVING IMPROVED GLOSS

(75) Inventor: Julie Baker, Leavesden (GB)

(73) Assignee: Eastman Kodak Company, Rochester, NY (US)

( * ) Notice: Subject to any disclaimer, the term of this patent is extended or adjusted under 35 U.S.C. 154(b) by 1099 days.

(21) Appl. No.: 11/570,605

(22) PCT Filed: Jun. 30, 2005

(86) PCT No.: PCT/GB2005/002560

§ 371 (c)(1),
(2), (4) Date: Dec. 14, 2006

(87) PCT Pub. No.: WO2006/003391

PCT Pub. Date: Jan. 12, 2006

(65) Prior Publication Data

US 2008/0062234 A1 Mar. 13, 2008

(30) Foreign Application Priority Data

Jul. 7, 2004 (GB) ..... 0415212.0

(51) Int. Cl.
*B41M 5/40* (2006.01)

(52) U.S. Cl. ..... 428/32.21; 428/32.24; 428/32.25; 428/32.26; 428/32.34; 428/32.35; 347/95; 347/105; 427/243

(58) Field of Classification Search ..... 428/32.21, 428/32.24, 32.25, 32.26, 32.34, 32.35; 427/243; 347/95, 105

See application file for complete search history.

(56) References Cited

U.S. PATENT DOCUMENTS

| | | | | |
|---|---|---|---|---|
| 4,877,686 | A | 10/1989 | Riou et al. | |
| 5,576,088 | A * | 11/1996 | Ogawa et al. | 428/32.33 |
| 6,037,050 | A | 3/2000 | Saito et al. | |
| 6,419,987 | B1 | 7/2002 | Bauer et al. | |
| 2003/0138604 | A1 * | 7/2003 | Landry-Coltrain et al. | 428/195 |
| 2004/0022968 | A1 * | 2/2004 | Liu et al. | 428/32.25 |
| 2004/0115369 | A1 | 6/2004 | Yoshida et al. | |

* cited by examiner

*Primary Examiner* — Betelhem Shewareged
(74) *Attorney, Agent, or Firm* — Chris P. KonKol; Andrew J. Anderson

(57) ABSTRACT

The use of a boric acid, borate or derivate and/or salt thereof in a subbing layer coated onto a non resin-coated support beneath an upper layer comprising a binder and an inorganic particulate material such as fumed silica and an under layer between the upper layer and the subbing layer, which under layer comprises a binder and an inorganic particulate material such as calcium carbonate, increases the gloss of an ink jet receiver formed thereby whilst maintaining good ink absorption, good image density and minimizing puddling and associated coalescence, and where the receiver otherwise suffers from surface-cracking, decreases the propensity to cracking.

12 Claims, No Drawings

INK-JET RECEIVER HAVING IMPROVED GLOSS

FIELD OF THE INVENTION

The present invention relates to the field of ink-jet printing and to ink-jet applications requiring a porous ink-jet receiver. More particularly, the present invention relates to a porous ink-jet receiver, especially for use with pigmented inks, having improved gloss and to a method of making such a receiver.

BACKGROUND OF THE INVENTION

Ink-jet receivers are generally classified in one of two categories according to whether the principal component material forms a layer that is "porous" or "non-porous" in nature. Many commercial photo-quality porous receivers are made using a relatively low level of a polymeric binder to lightly bind inorganic particles together to create a network of interstitial pores which absorb ink by capillary action. These receivers can appear to dry immediately after printing and consequently are often the preferred technology as the speed and quantity of ink applied increases. A common problem with such porous receivers is how to achieve a glossy, crack-free receiving layer whilst having minimal effect on puddling and coalescence and yet maintaining good image quality. This is particularly difficult to achieve when a non resin-coated support such as plain paper is utilised to produce a reduced cost receiver.

Much effort has gone into trying to provide ink-jet receivers having improved performance and appearance.

U.S. Pat. No. 6,037,050 (Saito et al) describes an ink-jet recording sheet having a void layer with high ink-absorption with a minimum amount of solid fine particles dispersed in a hydrophilic binder which is cross-linked with a hardener. It discloses, for example, an ink-jet receiver prepared by coating an dispersion of fine silica particles (0.07 μm), PVA, surfactant and sodium tetraborate onto a paper support and allowing the coated support to dry. The dry thickness of the void layer is up to 50 μm and the weight ratio of hydrophilic binder to fine inorganic particles is stated to be within the range of from 1:15 to 1:1.

US-A-2004/0115369 (Yoshida et al) describes an inkjet recording element where an image-recording layer on a support such as paper comprises a pigment, especially alumina, and a binder such as PVA. A treatment solution comprising both boric acid and a borate is applied to the image-recording layer coated on the support, in its wet state, to solidify the binder in the image recording layer. The receiver, while still wet, is then pressed in contact with a heated mirror surface to impart gloss.

U.S. Pat. No. 4,877,686 (Riou et al) describes a method intended to eliminate quality defects associated with the size, shape and uniformity of dots formed through ink-jet printing and in particular to address the blurred appearance arising from large dots with heterogeneous density and extremely irregular shapes of small dots arising from hair cracks in the receiving layer, by using coagulating and gelling products in combination with polyhydroxylic polymeric binders to produce an ink-jet recording sheet which absorbs ink homogeneously and uniformly. It discloses, for example, an ink-jet receiver comprising a relatively porous, absorbent base paper coated with a 5% solution of borax providing a laydown of 0.4 $g/m^2$ and then coated with a 10% solids aqueous dispersion of fine powdered silica, powdered aluminium silicate having a mean diameter of 2.5 μm and polyvinyl alcohol, in a weight ratio of 70:30:30. There is no disclosure of using the borax to increase the surface gloss of the receiver.

U.S. Pat. No. 6,419,987 (Bauer et al) describes a method for increasing the viscosity of a film-forming polymer coating on a moving web to allow higher coating rates and reduced defects in the manufacture of, for example, ink-jet media, by pre-coating a viscosity increasing agent in a first solution and drying prior to coating a second solution containing the film forming polymer. It discloses, for example, an ink-jet receiver prepared by coating a solution of borax and PVP at a dry laydown of 0.11 $g/m^2$ and 0.012 $g/m^2$ respectively onto a PET support and then drying prior to simultaneously coating a two-layer receiving layer comprising a 10% solids solution of PVA and a mordant in a ratio of 75/25 by weight as a base layer and a 5% solids combination of fumed alumina and PVA in a 90/10 ratio by weight as an overcoat layer. There is no disclosure of there being any effect on the gloss of the receiver.

Achieving sufficient gloss whilst maintaining a high ink-absorption rate and good image properties is particularly problematic in porous ink-jet receivers comprising high proportions of inorganic particulate materials when the ink-receiving layer is coated onto non resin-coated support.

PROBLEM TO BE SOLVED BY THE INVENTION

It is, therefore an object of the invention to provide a porous ink-jet receiver, which has a highly glossy appearance, whilst maintaining a high ink-absorption rate, even when the ink-receiving layer(s) are coated onto a non resin-coated support.

It is a further object of the invention to provide a porous ink-jet receiver, which has reduced propensity to cracking, whilst minimising puddling of ink on the surface of the receiver.

It has been found by the present inventor that the surface gloss, and propensity to cracking, of a receiver having an upper layer comprising a binder and an inorganic particulate material such as fumed and/or colloidal silica and an under layer comprising a binder and calcium carbonate can be controlled by incorporating into a subbing layer between the under layer and the support a boric acid, borate or derivative and/or salt thereof in varying amounts relative to the amounts of binder in the under layer, as well as, where appropriate, controlling cracking whilst maintaining the rate of ink-uptake thereby minimizing puddling.

SUMMARY OF THE INVENTION

Accordingly, in a first aspect of the invention, there is provided an ink-jet receiver comprising a non resin-coated support; a subbing layer comprising a boric acid, borate or derivative and/or salt thereof; an upper layer comprising a binder and a first inorganic particulate material having a mean particulate diameter of 500 nm or less; and an under layer, between the subbing layer and the upper layer, said under layer comprising a binder and an inorganic particulate material.

In a second aspect of the invention, there is provided a method of manufacturing an ink-jet receiver as described above, said method comprising coating a subbing formulation onto a support to form a subbing layer on said support, said subbing formulation comprising an aqueous dispersion of an adhesive polymer material and a boric acid, borate or derivative and/or salt thereof, and allowing said subbing layer to dry; coating a first coating formulation onto the support above the subbing layer to form an under layer on said support, said first coating formulation comprising an aqueous dispersion of a second inorganic particulate material and a binder; coating onto the support above the first coating formulation a second coating formulation to form an upper layer above said under layer, said second coating formulation comprising an aqueous dispersion of a binder and a first inorganic particulate material having a mean diameter of 500 nm or less; and drying the coated support.

In a third aspect of the invention, there is provided the use of a boric acid, derivative or salt thereof to improve the gloss of an ink-jet receiver comprising a non-resin coated support and an ink-receiving layer having an upper layer and an under layer, which upper layer comprises a binder and a first inorganic particulate material and which under layer comprises a second inorganic particulate material having a larger mean particulate diameter than the first inorganic particulate material, by incorporating said boric acid, borate or derivative and/or salt thereof into a subbing layer between the support and an ink-receiving layer.

In a fourth aspect of the invention, there is provided the use of a boric acid, borate or derivative and/or salt thereof to improve the gloss of an ink-jet receiver comprising a non resin-coated support and an ink-receiving layer having an upper layer and an under layer, which upper layer comprises a binder and a first inorganic particulate material and which under layer comprises a second inorganic particulate material having a larger mean particulate diameter than the first inorganic particulate material, by incorporating said boric acid, borate or derivative and/or salt thereof into the under layer coated onto said support prior to the upper layer.

In a fifth aspect of the invention, there is provided a use of a boric acid, borate or derivative and/or salt thereof to prevent cracking in an ink-jet receiver comprising a non resin-coated support, an upper layer comprising a binder and a first inorganic particulate material having a mean diameter of from 120 to 500 nm; and an under layer comprising a binder and a second inorganic particulate material, which said second inorganic particulate material has a mean diameter greater than that of said first inorganic particulate material, by incorporating said boric acid, borate or derivative and/or salt thereof into a subbing layer between the support and the ink-receiving layer.

In a sixth aspect of the invention, there is provided a method of printing, said method comprising the steps of providing an ink-jet printer capable of responding to digital data signals, providing said printer with ink, providing the printer with an ink-jet receiver as defined above, and causing a set of digital signals corresponding to a desired printed image to be sent to said printer.

In a seventh aspect of the invention, there is provided a printed receiver comprising an image printed onto a receiver as defined above, by the method described above.

ADVANTAGEOUS EFFECT OF THE INVENTION

The ink-jet receiver according to the invention has a high gloss despite being coated on a non resin-coated support, whilst maintaining a high rate of ink-absorption and excellent printing properties, including excellent image density and is particularly advantageous when used with pigmented inks.

DETAILED DESCRIPTION OF THE INVENTION

The ink-jet receiver of the present invention, which has excellent printing properties and exhibits improved gloss whilst maintaining an excellent ink-absorption rate, comprises a non resin-coated support, a subbing layer comprising a boric acid, borate or derivative and/or salt thereof, an upper layer comprising a binder and a first inorganic particulate material having a mean particulate diameter of 500 nm or less; and an under layer, between the subbing layer and the upper layer, said under layer comprising a binder and an inorganic particulate material.

The subbing layer is preferably coated onto the support prior to coating the under layer, e.g. the subbing layer may be coated in a separate pass of a coating station to that of the under layer.

The subbing layer, which improves the adhesion of the under layer to the support, typically comprises a polymer material such as sulfonated polyesters, gelatin, poly(vinyl pyrrolidone), cellulose ethers and their derivatives such as methyl cellulose, capable of improving the adhesion of the under layer to the support. Suitable boric acid, borates or derivatives and/or salts thereof for use in the subbing layer include sodium borates, derivatives of boric acid, boric anhydride and the like. A particularly preferred borate is sodium tetraborate decahydrate, which is available from Borax Limited under the trade name Borax® Decahydrate.

The subbing layer preferably comprises a polymer that does not substantially react with the boric acid, borate or derivative and/or salt thereof, and more preferably does not cross-link with the boric acid, borate or derivative and/or salt thereof at all. Examples of suitable such polymers include sulfonated polyesters, gelatin, poly(vinyl pyrrolidone) cellulose ethers and their derivatives such as methyl cellulose, most preferably a sulfopolyester, which is available from Eastman Chemical Company under the trade name Eastek® 1400.

The relative amounts of boric acid, borate or derivative and/or salt thereof and polymer in the subbing layer may be adjusted as desired, and are preferably present in a weight for weight ratio of polymer to boric acid, borate or derivative and/or salt thereof of from 80:20 to 40:60, more preferably 75:25 to 60:40, still more preferably about 70:30. The dry laydown of the boric acid, borate or derivative and/or salt thereof is preferably varied depending upon the amount of binder present in the preferably adjacent under layer such that, for example, the weight for weight ratio of binder in the under layer to boric acid, borate or derivative and/or salt thereof in the subbing layer is from 20:1 to 1:1, more preferably 5:1 to 3:1 and most preferably about 4:1.

By adjusting the amount of boric acid, borate or derivative and/or salt thereof utilised in the subbing layer relative to the amount of binder in the under layer, the gloss of the ink-jet receiver produced may be controlled, and by carefully selecting the amount of boric acid, borate or derivative and/or salt thereof relative to the amount of binder in the under layer, a receiver with high gloss may be formed without significant detriment to the ink-absorption rate and image density.

The preferred amount of the dry laydown of boric acid, borate or derivative and/or salt thereof, depends upon the proportions of components in the other layers and on the desired properties, but typically are from 0.1 to 4 $g/m^2$, preferably 0.2 to 3.5 $g/m^2$, still more preferably 0.4 to 3 $g/m^2$ and most preferably from 0.9 to 2.5 $g/m^2$.

Optional additional components for inclusion in the subbing layer include surfactants, for facilitating coating of the subbing layer onto the support.

In the upper layer of the ink-jet receiver according to the present invention, the first inorganic particulate material, which may be an agglomerated particulate material or a primary particulate material, and which has a mean particulate diameter of 500 nm or less, preferably has a mean particulate diameter of from 40 to 180 nm, more preferably 60 to 160 nm.

Where the first inorganic particulate material is an agglomerated particulate material, the agglomerated particles preferably have a mean particulate diameter of from 120 to 180 nm, more preferably from 140 to 160 nm and most preferably about 150 nm and may be composed of particles having a primary mean diameter of up to 50 nm, preferably at least 1 nm, more preferably up to 40 nm, still more preferably up to 30 nm, still more preferably up to 25 nm and most preferably from 15 to 25 nm. Where the first inorganic particulate material is a primary particulate material, the mean particulate diameter is preferably from 60 to 100 nm, more preferably 60 to 90 nm and most preferably about 80 nm. The first inorganic particulate material may be any suitable inorganic particulate meeting the above particle size requirements and capable of forming a porous receiving layer with a suitable binder in the aforementioned relative amounts. Preferably the first inorganic particulate material is an agglomerated particulate material.

Suitable such inorganic particulate materials may include, for example, one or more metal oxides such a silica (e.g. fumed silica and colloidal silica), alumina (e.g. fumed alumina, alumina sols, colloidal alumina, cationic aluminium oxide or hydrates thereof, pseudoboehmite, etc.), titania, zirconia, ceria and magnesia, or surface-treated cationic colloidal silica, magnesium silicate, aluminium silicate, magnesium carbonate, kaolin, talc, calcium sulfate, barium sulfate, titanium dioxide, zinc oxide, zinc sulfide, zinc carbonate, satin white, diatomaceous earth, calium cilicate, aluminium hydroxide, lithopone, zeolite (such as molecular sieves 3A, 4A, 5A and 13X), hydrated hallocyte, or magnesium hydroxide. Preferably, the first inorganic particulate material is selected from one or more of fumed metal oxides, finely milled metal oxide gels and colloidal silica, with fumed silica and/or colloidal silica being most preferred.

The binder used in the upper layer of the ink-jet receiver may be any binder capable of effectively binding the first inorganic particulate material to form a porous ink-receiving layer capable of retaining a pigment or dye, preferably a pigment, to form a printed image having good image properties. Suitable such binders include, for example, one or more of naturally occurring hydrophilic colloids and gums such as gelatin, albumin, guar, xantham, acacia and chitosan and their derivatives, functionalised proteins, functionalised gums and starches, cellulose ethers and their derivatives, such as hydroxyethyl cellulose, hydroxypropyl cellulose and carboxymethyl cellulose, polyvinyl oxazoline and polyvinyl methyloxazoline, polyoxides, polyethers, poly(ethylene imine), poly(acrylic acid), poly(methacrylic acid), n-vinyl amides including polyacrylamide and polyvinyl pyrrolidone, polyethylene oxide and polyvinyl alcohol, its derivatives and copolymers, and most preferably polyvinyl alcohol.

Preferably, the binder is present in the upper layer in an amount as a ratio of inorganic particulate materials to binder of from 70:30 to 99:1, preferably 75:25 to 96:4 and still more preferably 85:15 to 95:5.

Optionally, the upper layer may comprise a further inorganic particulate material to supplement or enhance the properties of the first inorganic particulate material. Preferably, where a further inorganic particulate material is utilised in the upper layer, it has a mean particulate diameter less than that of the first inorganic particulate material and typically 200 nm or less, preferably 60 to 100 nm, more preferably 70 to 90 nm and most preferably about 80 nm and preferably from 25% to 75% of that of the first inorganic particulate material, more preferably of from 40% to 70%.

The relative proportions of any such further inorganic particulate material to the first inorganic particulate material and the binder in the under layer may be adjusted as desired, with regard, for example, to beneficial properties, such as reduced propensity to cracking whilst minimizing puddling of ink and associated coalescence, as described in our co-pending UK Patent Application of even date (our reference: 88426GB), the content of which is incorporated herein by reference. Therefore, the further inorganic particulate material in the upper layer is preferably present in an amount of from 3% to 20% by weight of the total inorganic particulate material laydown in the upper layer, more preferably 5% to 15%.

Such a further inorganic particulate material may be any suitable inorganic particulate meeting the above particle size requirements and capable of forming a porous receiving layer with the first inorganic particulate material and a suitable binder in the aforementioned relative amounts. Suitable such inorganic particulate materials may include, for example silica (e.g. colloidal silica), alumina (e.g. alumin sols, colloida alumina, cationic aluminium oxide or hydrates thereof, pseudoboehmite, etc.), surface-treated cationic colloidal silica, magnesium silicate, aluminium silicate, magnesium carbonate, kaolin, talc, calcium sulfate, barium sulfate, titanium dioxide, zinc oxide, zinc sulfide, zinc carbonate, satin white, diatomaceous earth, calium cilicate, aluminium hydroxide, lithopone, zeolite(s) (such as molecular sieves 3A, 4A, 5A and 13X), hydrated hallocyte and magnesium hydroxide. Preferably, such a further inorganic particulate material in the upper layer is a colloidal silica. Examples of suitable colloidal silicas include, for example, Nalco® 1115 (4 nm), Ludox® SM-30 (7 nm), Ludox® LS-30 (12 nm), Ludox® TM-40 (22 nm), Ludox® AM (~30 nm), Ludox® TM-30 (~50 nm) and Ludox® PW-50 (~80 nm), or a mixture thereof, preferably Ludox® PW-50.

The amount of binder in the under layer and the amount of any such further inorganic particulate material in the upper layer may be varied to control the propensity to cracking of the receiver and the extent and occurrence of puddling (and associated coalescence). The precise amounts of binder in the under layer and of the second inorganic particulate material in the upper layer may depend upon the particular balance of cracking prevention and puddling occurrence desired and may also depend on the exact nature and physical features of the particulate materials used in each of the upper and under layers, the nature of the binders used, the relative thickness of the respective layers, the properties of particulate materials used in each layer and on the presence or not of any further layers.

Depending upon these variables, the amount of binder in the under layer and the amount of the second inorganic particulate material in the upper layer may be used to control both the amount of cracking and the amount of puddling in the resultant ink-jet receiver.

Other components which may be present in the upper layer of an ink-jet receiver according to the present invention include, for example, a surfactant and a mordant. Suitable surfactants for use in the top layer, for example to improve coatability of the coating composition, depending upon the coating method used, include fluorosurfactants such as Lodyne® S100 or Zonyl® FSN, or a non-fluoro surfactants such as Olin® 10G.

Suitable mordants, which may be useful to bind the dye or pigment in the ink in the upper part of the ink-receiving layer in order to improve still further the image density, include, for example, a cationic polymer, e.g. a polymeric quarternary ammonium compound, or a basic polymer, such as poly(dimethylaminoethyl)methacrylate, polyalkylenepolyamines, and products of the condensation thereof with dicyanodiamide, amine-epichlorohydrin polycondensates, divalent Group 11 metal ions, lecithin and phospholipid compounds or any suitable mordant that is capable of assisting with fixing a dye material transferred to it. Examples of such mordants include vinylbenzyl trimethyl ammonium chloride/ethylene glycol dimethacrylate, poly(diallyl dimethyl ammonium chloride), poly(2-N,N,N-trimethylammonium)ethyl methacrylate methosulfate, poly(3-N,N,N-trimethylammonium)propyl chloride. A preferred mordant would be a quarternary ammonium compound.

Optionally, the upper layer may comprise an amorphous hydrated aluminosilicate, such as an allophane, for the reduction of smearing of an image when a printed receiver is stored at high temperatures and humidities.

The second inorganic particulate material, utilised in the under layer of the ink-jet receiver according to the present invention, may be any suitable particulate material capable of, for example, behaving as a sump for a fluid (e.g. water or aqueous alcohol solution) of an ink to be applied to the receiver, when said particulate material is lightly bound by a suitable binder. Preferably, the second particulate material has a larger mean particulate diameter than the first inorganic particulate material of the upper layer. Suitable such inorganic particulate materials for use in the under layer include, for example, calcium carbonate, magnesium carbonate, kaolin, talc and zeolite(s).

Preferably, the inorganic particulate material in the under layer is calcium carbonate.

A suitable binder for use in binding the second inorganic particulate material in the under layer may be any binder capable of effectively binding the inorganic particular material to form an under layer effective as a sump for carrier fluid used in ink to be applied to the receiver. Suitable such binders include, for example, one or more of naturally occurring hydrophilic colloids and gums such as gelatin, albumin. guar, xantham, acacia and chitosan and their derivatives, functionalised proteins, functionalised gums and starches, cellulose ethers and their derivatives, such as hydroxyethyl cellulose, hydroxypropyl cellulose and carboxymethyl cellulose, polyvinyl oxazoline and polyvinyl methyloxazoline, polyoxides, polyethers, poly(ethylene imine), poly(acrylic acid), poly (methacrylic acid), n-vinyl amides including polyacrylamide and polyvinyl pyrrolidone, polyethylene oxide and polyvinyl alcohol, its derivatives and copolymers, especially a binder capable of being cross-linked by boric acid, borate or derivative and/or salt thereof, such as polyurethanes, polyvinyl alcohols, acrylics, polyolefins, polyesters, polyamides, polycarbonates, polyethers, polyureas, poly(vinyl halides), polysilanes, polysiloxanes and hybrids thereof, for example poly (ester-amides) and the like, preferably having functional groups capable of interacting with a boric acid, borate or derivative and/or salt thereof, and most preferably polyvinyl alcohol.

Preferably, the binder in the under layer is present in an amount of up to 25% by weight of the combined weight of inorganic particulate material and binder in the under layer, more preferably from 1% to 20%, e.g. about 5% to about 15%, and still more preferably from 1% to 3%, especially about 2%.

Optionally other components may be present in the under layer of the ink-jet receiver, such as a surfactant to improve coatability of the coating composition, depending upon the coating method used. Suitable such surfactants include fluorosurfactants such as Lodyne® S100 or Zonyl® FSN, or a non-fluoro surfactants such as Olin® 10G.

The support may be any non resin-coated support suitable for use in an ink-jet receiver, such as plain or calendared paper, acetate, polyethylene terephthalate (PET), a printing plate support, aluminium foil, latex-treated polyester, microporous materials such as Teslin® (available from PPG Industries, Inc) or Tyvek® synthetic paper (available from Du Pont) or any other suitable support. Preferably the support is non resin-coated paper (plain or calendared).

In a particularly preferred embodiment of the present invention, the ink-jet receiver comprises a subbing layer which comprises a boric acid, borate or derivative and/or salt thereof, coated onto a support, which is preferably a non resin-coated paper support; an under layer coated onto the subbing layer, which under layer comprises calcium carbonate and a binder; and an upper layer coated onto the under layer, which upper layer comprises a binder and a silica, which may be fumed and/or colloidal silica. Preferably, the binder utilised in both the upper layer and the under layer is polyvinyl alcohol.

Any suitable coating method may be used to coat the layers of the ink-jet receiver onto the support, including, amongst others, curtain coating, bead coating, extrusion coating, air knife coating, rod coating or blade coating. Preferably, the layers are coated by extrusion coating.

The subbing layer is preferably coated onto the support prior to and separately from the under and upper layers of the ink-jet receiver. The upper and under layers may then be coated simultaneously, optionally as adjacent layers, or separately. Preferably the upper layer and the under layer are each coated as a single layer, but optionally either or both of the upper and under layers may be coated as two or more layers which layers may have the same or different compositions.

The support is preferably coated to provide a dry weight of up to about 25 g/m$^2$ of material in the upper layer, preferably from 5 to 20 g/m$^2$ and more preferably from about 10 to 15 g/m$^2$. A dry weight of material in the under layer coated onto the support is preferably up to about 50 g/m$^2$, more preferably from 15 to 35 g/m$^2$ and most preferably about 25 g/m$^2$.

Optionally, further inter-layers may be coated between the under layer and the upper layer and/or between the subbing layer and the under layer, which inter-layer(s) may optionally comprise a polymer, such as binder polymer, a polymeric or inorganic particulate material, a mordant etc. Preferably, however, the ink-jet receiver comprises solely of a support, a subbing layer coated thereon, an under layer coated onto the subbing layer and an upper layer coated onto the under layer.

As will be illustrated by the following Examples, the amount of boric acid, borate or derivative and/or salt thereof utilised, especially with respect to the amount of binder in the under layer can be used to control, and to maximize, the gloss of the receiver formed without causing puddling of ink on the surface and without increasing the propensity to cracking, both of which are typically associated with increased gloss in porous ink-jet receivers. It is particularly desirable for the relative amounts of the components of the ink-jet receiving layer to be chosen to form an ink-receiving layer having a gloss at 60° of at least 40. Furthermore, as is shown in the following Examples, where the ink-receiving layer is otherwise susceptible to cracking, such as with a high proportion of fumed silica, the presence of the subbing layer with boric acid, borate or derivative and/or salt thereof reduces its susceptibility to cracking. Accordingly, as well as improving gloss, a subbing layer comprising a boric acid, borate or derivative and/or salt thereof may be utilised to assist in reducing the susceptibility of a receiver to cracking without having to compromise the porosity of the ink-jet receiver which otherwise may lead to puddling, by, for example, substituting fumed silica with colloidal silica.

In a most preferred embodiment, an ink-jet receiver having improved gloss and reduced propensity for cracking may be prepared by balancing the respective amounts of boric acid, borate or derivative thereof in the subbing layer, binder in the under layer and the proportions of two or more inorganic particulate materials having different absorptive/cracking properties in the upper layer (e.g. fumed and colloidal silica).

The ink-jet receiver of the present invention may be used with pigment or dye based inks. It is a particularly effective receiver, however, when used with pigment based inks.

The invention will now be described in detail, without limitation as to the scope of the invention, according to the following examples.

EXAMPLES

Example 1

A non resin-coated paper support was coated with three layers in two different passes through a coating track.

For coating A, a subbing layer was applied to the support in the first pass through the coating track. This consisted of a 70/30 mix of an aqueous dispersion of a sulfopolyester (Eastek® 1400) and Borax® Decahydrate (sodium tetraborate decahydrate). The dry laydown of the Borax® Decahydrate was dependent on the dry laydown of binder used in the calcium carbonate bottom layer to be applied in the second pass through the coating track, where the ratio of binder in the bottom layer to Borax® Decahydrate was 4:1. In this particular coating, the Borax® Decahydrate was coated at a laydown of 0.938 g/m$^2$ and the sulfopolyester was coated at a laydown of 2.19 g/m$^2$. This layer was coated on a bead-coating machine using a slide over extrusion hopper.

In the second pass through the coating track, two more layers were applied on top of the subbing layer. The bottom layer next to the subbing layer contained calcium carbonate (Albaglos S™ supplied by Specialty Minerals) and PVA (Gohsenol® GH17 supplied by British Traders) as a binder. The total dry laydown of this layer was 25 g/m$^2$ with the ratio of calcium carbonate:PVA coated at 85:15. The top layer contained fumed silica (Cab-O-Sperse® PG002 supplied by Cabot Corp), PVA (Gohsenol® GH17 supplied by British Traders) as a binder and some surfactant (Zonyl® FSN). The total dry laydown of this layer was 15.2 g/m$^2$ with the silica/PVA/surfactant ratio of 89/10/1.

These two layers were coated simultaneously over the pre-coated subbing layer on a bead-coating machine using a slide over extrusion hopper.

Coating B was prepared in the same way as coating A, except the subbing layer applied in the first pass through the coating track did not contain any Borax® Decahydrate. For this coating, the sulfopolyester was coated at a laydown of 3.12 g/m$^2$ in order to keep the % solids of the melt the same as coating A.

For coating C, no subbing layer was used and the bottom layer containing calcium carbonate (Albaglos S™ supplied by Specialty Minerals) and PVA (Gohsenol® GH17 supplied by British Traders) as a binder and the top layer containing fumed silica (Cab-O-Sperse® PG002 supplied by Cabot Corp), PVA (Gohsenol® GH17 supplied by British Traders) as a binder and some surfactant (Zonyl® FSN) were coated directly onto the non resin coated paper base.

Images were then printed onto coatings A-C using an Epson® PX-G900 printer and inkset. A qualitative evaluation of the cracking on each of the coatings was then made ranging from 4 to 1 (see key below). Average 60° gloss of the printed areas was measured using a Sheen Instruments Ltd, 160 Tri-Microgloss™ meter. Table 1 shows the average gloss for each of the coatings and how the degree of cracking was ranked for each coating.

4=extremely cracked
3=less cracking
2=minor cracking
1=no cracking.

TABLE 1

Coating A-C subbing layer effects on gloss and cracking

| Ctg | Eastek ® 1400 (g/m$^2$) | Borax ® (g/m$^2$) | Crack Rating | Avg Gloss |
|---|---|---|---|---|
| A | 2.19 | 0.938 | 1 | 64.7 |
| B | 3.12 | — | 3 | 31.8 |
| C | — | — | 4 | 12.5 |

The data in Table 1 indicate that gloss is improved as soon as a subbing layer is used compared to when the layers were coated directly onto the non resin coated paper (coating B vs. coating C). However, a much larger improvement in gloss is seen when the subbing layer contained Borax® Decahydrate. This was also the only coating not to show any cracking.

Example 2

Coatings D-H were prepared in the same way as coating A, except the level of Borax® Decahydrate in the subbing layer was varied (as shown in Table 2).

TABLE 2

Subbing layer variations for coatings D-H

| Coating | Eastek 1400 (g/m$^2$) | Borax (g/m$^2$) |
|---|---|---|
| D | 2.19 | 2.500 |
| E | 2.19 | 0.469 |
| F | 2.19 | 0.250 |
| G | 2.19 | 0.188 |
| H | 2.19 | — |

Images were then printed onto coatings D-H using the Epson® PX-G900 printer and inkset. A qualitative evaluation of the cracking on each of the coatings was then made ranging from 4 to 1 and the average 60° gloss of the printed areas was measured using a Sheen Instruments Ltd, 160 Tri-Microgloss™ meter and compared to coating A to illustrate the effect of the Borax® Decahydrate level in the subbing layer on average gloss and cracking. The results can be seen in Table 3.

TABLE 3

Coating D-H subbing layer effects on gloss and cracking

| Ctg | Borax ® (g/m$^2$) | B/L PVA:Borax | Crack Rating | Avg Gloss |
|---|---|---|---|---|
| D | 2.500 | 1.5:1 | 1 | 64.3 |
| A | 0.938 | 4:1 | 1 | 64.7 |
| E | 0.469 | 8:1 | 2 | 63.3 |
| F | 0.250 | 15:1 | 2 | 39.4 |
| G | 0.188 | 20:1 | 3 | 32.1 |
| H | — | N/A | 3 | 30.8 |

The data in Table 3 show that the Borax® Decahydrate level in then subbing layer has a large effect on both the average gloss and the degree of cracking seen. To get maximum benefit, the ratio of binder in the bottom layer to Borax® Decahydrate should preferably be at most 4:1.

Example 3

Coatings I-K were prepared in the same way as coatings A-C, except the top layers contained colloidal silica (Ludox® PW-50 supplied by Grace Davison) instead of the fumed silica (Cab-O-Sperse® PG002).

Images were then printed onto coatings I-K using the Epson® PX-G900 printer and inkset. A qualitative evaluation of the cracking on each of the coatings was then made ranging from 4 to 1 and the average 60° gloss of the printed areas was measured using a Sheen Instruments Ltd, 160 Tri-Microgloss™ meter. Table 4 shows the average gloss or each of the coatings and how the degree of cracking was ranked for each coating.

TABLE 4

Coating I-K subbing layer effects on gloss and cracking

| Ctg | Eastek ® 1400 ($g/m^2$) | Borax ® ($g/m^2$) | Crack Rating | Avg Gloss |
|---|---|---|---|---|
| I | 2.19 | 0.938 | 1 | 58.6 |
| J | 3.12 | — | 1 | 35.1 |
| K | — | — | 1 | 26.1 |

The data in Table 4 indicate that none of the coatings showed any cracking when the top layer contained colloidal silica instead of fumed silica. However, the large improvement in gloss was still seen when a subbing layer containing Borax® Decahydrate was coated onto the non resin coated paper before the calcium carbonate and silica layers were applied.

The invention claimed is:

1. An ink jet receiver comprising
a non resin-coated support;
a subbing layer comprising a boric acid, borate or derivative and/or salt thereof;
an upper layer having a dry weight of from 5 to 25 $g/m^2$ and comprising a binder and a first inorganic particulate material having a mean particulate diameter of 500 nm or less; and
an under layer, between said subbing layer and said upper layer, said under layer having a dry weight of up to 50 $g/m^2$ and comprising a binder and a second inorganic particulate material,
wherein the weight ratio of said binder in said under layer to said boric acid, borate or derivative and/or salt thereof in said subbing layer is 4:1 or less.

2. An ink-jet receiver as claimed in claim 1, wherein said second inorganic particulate material has a mean diameter greater than that of said first inorganic particulate material.

3. An ink jet receiver as claimed in claim 2, wherein said second inorganic particulate material has a mean particulate diameter of from 500 to 1500 nm.

4. An ink-jet receiver as claimed in claim 1, wherein said second inorganic particulate material is calcium carbonate.

5. An ink-jet receiver as claimed in claim 1, wherein said first inorganic particulate material comprises fumed silica and/or colloidal silica.

6. An ink jet receiver as claimed in claim 1, wherein said binder in said under layer is present in an amount of from 1% to 20% by weight of the combined weight of said inorganic particulate material and said binder in said under layer.

7. An ink-jet receiver as claimed in claim 6, wherein said binder in said under layer is present in an amount of from 1% to 3% by weight of the combined weight of said inorganic particulate material and said binder in said under layer.

8. An ink jet receiver as claimed in claim 1, wherein said first inorganic particulate material has a mean diameter of from 60 to 180 nm.

9. An ink-jet receiver as claimed in claim 1, wherein said subbing layer comprises said boric acid, borate or derivative and/or salt thereof in a dry laydown of from 0.1 to 4 $g/m^2$.

10. An ink jet receiver as claimed in claim 1, wherein said subbing layer comprises a polymer that does not substantially react with said boric acid, borate or derivative thereof and/or salt thereof and the weight for weight ratio of said polymer to said boric acid, borate or derivative thereof and/or salt thereof is from 80:20 to 40:60.

11. A method of manufacturing an ink jet receiver, said ink-jet receiver comprising
a non resin-coated support;
a subbing layer comprising a boric acid, borate or derivative and/or salt thereof;
an upper layer comprising a binder and a first inorganic particulate material; and
an under layer, between said subbing layer and said upper layer comprising a binder and a second inorganic particulate material,
wherein the weight ratio of said binder in said under layer to said boric acid, borate or derivative and/or salt thereof in said subbing layer is 4:1 or less;
said method comprising
coating a subbing formulation onto a said support to form said subbing layer, said subbing formulation comprising an aqueous dispersion of an adhesive polymer material and said boric acid, borate or derivative and/or salt thereof, and allowing said subbing layer to dry;
coating a first coating formulation onto said support above said subbing layer to form said under layer, having a dry weight of up to 50 $g/m^2$, on said support, said first coating formulation comprising an aqueous dispersion of said second inorganic particulate material and said binder;
coating onto said support above said first coating formulation a second coating formulation to form said upper layer, having a dry weight of from 5 to 25 $g/m^2$, above said under layer, said second coating formulation comprising an aqueous dispersion of said binder and said first inorganic particulate material having a mean diameter of 500 nm or less; and
drying the coated support.

12. A method of printing, said method comprising the steps of providing an ink-jet printer capable of responding to digital data signals, providing said printer with ink, providing the printer with an ink-jet receiver and causing a set of digital signals corresponding to a desired printed image to be sent to said printer, said ink-jet receiver comprising
a non resin-coated support;
a subbing layer comprising a boric acid, borate or derivative and/or salt thereof;
an upper layer having a dry weight of from 5 to 25 $g/m^2$ and comprising a binder and a first inorganic particulate material having a mean particulate diameter of 500 nm or less; and
an under layer, between said subbing layer and said upper layer, said under layer having a dry weight of up to 50 $g/m^2$ and comprising a binder and a second inorganic particulate material,
wherein the weight ratio of said binder in said under layer to said boric acid, borate or derivative and/or salt thereof in said subbing layer is 4:1 or less.

* * * * *